US007549367B2

(12) United States Patent
Hill

(10) Patent No.: US 7,549,367 B2
(45) Date of Patent: Jun. 23, 2009

(54) CONTROL SYSTEM FOR A WEAPON MOUNT

(75) Inventor: Robert D. Hill, Logan, UT (US)

(73) Assignee: Utah State University Research Foundation, North Logan, UT (US)

( * ) Notice: Subject to any disclaimer, the term of this patent is extended or adjusted under 35 U.S.C. 154(b) by 425 days.

(21) Appl. No.: 11/039,296

(22) Filed: Jan. 20, 2005

(65) Prior Publication Data

US 2005/0263000 A1 Dec. 1, 2005

Related U.S. Application Data

(60) Provisional application No. 60/538,280, filed on Jan. 20, 2004.

(51) Int. Cl.
*F41A 19/36* (2006.01)

(52) U.S. Cl. ..... 89/136

(58) Field of Classification Search ..... 89/136
See application file for complete search history.

(56) References Cited

U.S. PATENT DOCUMENTS 3,135,053 A * 6/1964 Newman et al. ..... 89/202
3,405,599 A * 10/1968 Brandstadter et al. ..... 89/41.09
3,575,085 A * 4/1971 McAdam, Jr. ..... 235/404
3,604,897 A 9/1971 McAdam, Jr. et al. ..... 235/61.5
3,604,912 A 9/1971 Frohock, Jr. ..... 235/197
3,844,196 A * 10/1974 Taylor et al. ..... 89/41.09
3,848,509 A * 11/1974 Corn ..... 89/41.22
3,955,292 A 5/1976 Robertson ..... 35/25
4,004,729 A * 1/1977 Rawicz et al. ..... 235/404
4,172,409 A * 10/1979 Looss et al. ..... 89/41.19
4,318,330 A * 3/1982 Hausenblas ..... 89/41.05
4,402,250 A 9/1983 Baasch ..... 89/41 AA
4,501,188 A * 2/1985 Wroble ..... 89/41.02
5,267,502 A * 12/1993 Gent et al. ..... 89/41.03
5,347,910 A * 9/1994 Avila et al. ..... 89/41.22
5,413,028 A * 5/1995 Ng et al. ..... 89/41.09
5,413,029 A 5/1995 Gent et al. ..... 89/41.3
5,520,085 A * 5/1996 Ng et al. ..... 89/41.03
5,586,887 A * 12/1996 McNelis et al. ..... 434/20
5,648,632 A * 7/1997 Becker et al. ..... 89/41.05
5,686,690 A * 11/1997 Lougheed et al. ..... 89/41.17
5,949,015 A * 9/1999 Smith et al. ..... 89/41.05
5,974,940 A 11/1999 Madoi et al. ..... 89/41.17
6,067,890 A 5/2000 Thiesen et al. ..... 89/41.03
6,491,253 B1 * 12/2002 McIngvale ..... 244/3.11
6,497,171 B2 12/2002 Gerber et al. ..... 89/41.09
6,596,976 B2 7/2003 Lin et al. ..... 244/3.2

(Continued)

OTHER PUBLICATIONS

Trivette, Jr., et al., "Technological Challenges for Geometric Pairing for the Dismounted Soldier," pp. 1-8.

(Continued)

*Primary Examiner*—Troy Chambers

(57) ABSTRACT

A control system stabilizes a turret having a gimbal and base and pointing a weapon mounted within the turret. The control system includes computer executable modules to receive turret data and operator commands and to modify operator commands in accordance with a generated line of sight vector and ballistic data. The modules include a time optimal controller to generate modified operator commands. The modules further include a gimbal stabilization controller to generate motor commands to stabilize the turret and point the weapon.

9 Claims, 6 Drawing Sheets

U.S. PATENT DOCUMENTS

| | | | | |
|---|---|---|---|---|
| 7,124,676 | B1 * | 10/2006 | Lowrance et al. | 89/41.06 |
| 2002/0046564 | A1 | 4/2002 | Rastegar et al. | 60/476 |
| 2003/0010190 | A1 | 1/2003 | Sammut et al. | 89/41.17 |
| 2003/0105588 | A1 | 6/2003 | Lin et al. | 702/1 |
| 2003/0140866 | A1 | 7/2003 | Malakatas | 119/524 |
| 2004/0050240 | A1 * | 3/2004 | Greene et al. | 89/41.06 |

OTHER PUBLICATIONS

Mindell, David A., Anti-Aircraft Fire Control and the Development of Integrated Systems at Sperry, 1925-1940, IEEE Control Systems, Apr. 1995, pp. 108-113.

Berg, Russell F., "Estimation and Prediction for Maneuvering Target Trajectories," Berg: Maneuvering Target Trajectories, IEEE Transactions on Automatic Control, vol. AC-28, No. 3, Mar. 1983, pp. 294-304.

Bigley et al., "Wideband Linear Quadratic Control of a Gyro-Stabilized Electro-Optical Sight System," IEEE Control Systems Magazine, 1987, pp. 20-24.

Gully et al., "Microcomputer Control Algorithms for Weapon Pointing and Stabilization," IEEE Control Systems Magazine, Computer Control Section, Sep. 1981, pp. 22-28.

Karabinis et al., "Antenna Pointing and Scanning Control for a Two Axis Gimbal System in the Presence of Platform Motion," 1988 IEEE, pp. 43.6.1-43.6.7.

Volz et al., "Design of a Digital Controller for a Tracking Telescope," IEEE Transactions on Automatic Control, vol. AC-12, No. 4, Aug. 1967, pp. 359-367.

"Technical Support Package," Inertial/GPS Pointing and Positioning System, NASA Tech Briefs, ARC-14060, Amex Research Center, Moffett Field, California 94035, 29 pgs.

Anagnost, John J., "Nonlinear Control of Unbalanced Gimbal Mechanisms," Hughes Aircraft Company, Electro-Optical Systems Division, P. O. Box 902, El Segundo, California 90245, pp. 383-387.

Held et al., "Tier II Plus Airborne EO Sensor LOS Control and Image Geolocation," 1997 IEEE, pp. 377-405.

Weiss et al., "Quaternion Based Rate/Attitude Tracking System With Application to Gimbal Attitude Control," RAFAEL, P.O. Box 2250, Haifa 31021, Israel, p. 1-7.

Algrain et al., "Accelerometer Based Line-of-Sight Stabilization Approach for Pointing and Tracking Systems," 1993 IEEE, pp. 159-163.

Savage, Paul G., "Strapdown Inertial Navigation Integration Algorithm Design Part 1: Attitude Algorithms," Journal of Guidance, Control, and Dynamics, vol. 21, No. 1, Jan.-Feb. 1998, pp. 19-28.

Savage, Paul G., "Strapdown Inertial Navigation Integration Algorithm Design Part 2: Velocity and Position Algorithms," Journal of Guidance, Control, and Dynamics, vol. 21, No. 2, Mar.-Apr. 1998, pp. 208-221.

Clark, et al., "Smart Structures in Army Weapon Systems," DARPA Smart Structures Technology Interchange Meeting, Baltimore, Maryland, Jun. 27, 2000, pp. 1-16.

* cited by examiner

CONTROL SYSTEM FOR A WEAPON MOUNT

RELATED APPLICATIONS

This application claims priority to U.S. Patent Application No. 60/538,280 filed on Jan. 20, 2004 and entitled "Control System for Remotely Operated Weapon Turrets."

TECHNICAL FIELD

The present invention relates to systems for a stabilizing a weapon mount and for pointing a weapon supported within the weapon mount.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, as claimed, but is merely representative of presently preferred embodiments of the invention.

The present invention provides a weapon control system to stabilize a base and gimbal assembly and point a mounted weapon. The control system includes various cascaded control loops that provide stabilization, pointing control, and ballistics compensation so that the mount can be operated by either a human operator or a tracking system. The architecture of the control system is such that communications between the operator's console can be connected through either a wire umbilical or a wireless link.

Figure 1:
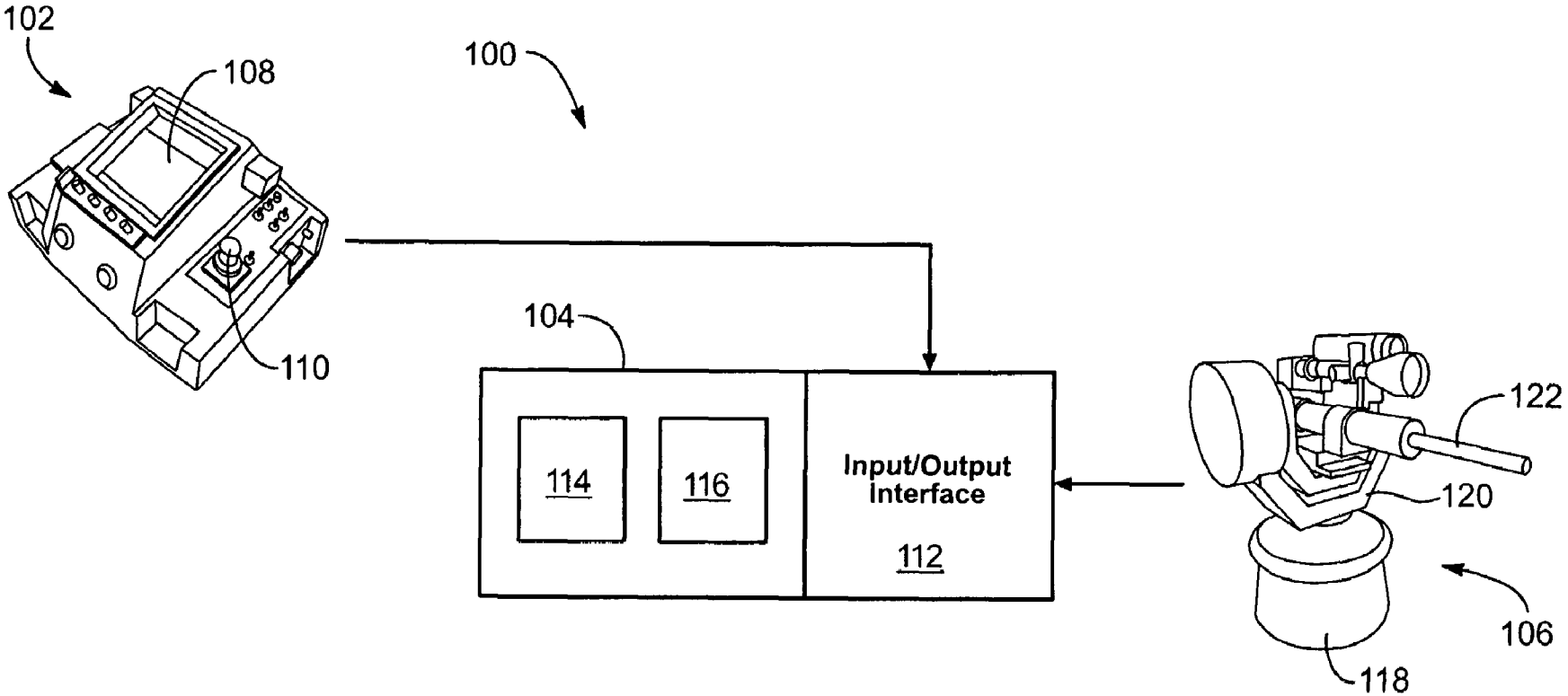
FIG. 1 is a block diagram of one embodiment of a weapon system.

Referring to FIG. 1, a weapon system 100 is shown which includes an operator console 102, a computer 104, and a weapon turret 106 which are all in electrical communication with one another. The weapon system 100 may be produced with a size and weight that is manually portable without a vehicle.

The operator console 102 may be embodied in a variety of ways and includes a housing that may be formed by blow molded plastic or metal. The operator console 102 may be sized to fit in ergonomically in a lap or may be configured to fit within an instrument panel of a vehicle. The operator console 102 includes input devices, such as switches, potentiometers, buttons, and the like, to receive operator commands relating to mode, positioning, and firing. The operator console 102 may further include a display 108 to provide a visual as viewed by a scope or camera mounted to the turret 106. The operator console 102 may include other input devices such as a joystick 110 or similar device to control movement of the turret 106. Additional input devices may provide overall system power control, mode control, servo amplification, and trigger control. The based on operator input, the operator console 102 generates operator commands that includes mode, slew, slew rate selector, joystick movement, and trigger. Operator commands are delivered to the computer 104 through hard wire or wireless connection.

The computer 104 includes a input/output interface 112 for data acquisition capabilities and to provide output to both the operator console 102 and to the turret 106. The computer 104 further includes a processor 114 for executing computer readable instructions and a memory 116 for storing one or more computer executable modules and data. Although modules may be implemented in software, one of skill in the art will appreciate that the modules may also be implemented in analog hardware or in a combination of software and hardware. Both processor 114 and memory 116 may be implemented using any one of a variety of commercially available components.

The weapon turret 106 may be sized and configured to receive and support a variety of different caliber weapons, including a .50 caliber weapon with a muzzle brake or a non-lethal weapon. The weapon turret 106 may be mounted on manned or unmanned aircraft, watercraft, and land vehicles. The weapon turret 106 can also be emplaced in fixed emplacements such as runway thresholds, bunkers, sentry points, military perimeters, outposts, or other field settings.

The turret 106 includes a base 118 that supports a two-axes gimbal 120. The two-axes gimbal 120 may include DC torque motors to provide movement in each axis and to support a weapon 122. The turret 106 includes angular rate sensors to measure the angle rate of each gimbal axis. An angular rate sensor may be embodied as a magneto-hydrodynamic angular rate sensor. An angular rate sensor may also be embodied as one or more rate gyros. The turret 106 may include position sensors, such as rotary potentiometers, resolvers, or encoders, to measure the gimbal axes angles. In application, resolvers are more robust and have superior resolution than other sensors, but an optical encoder may also be used. The turret 106 may include a GPS or variant of a GPS such as GLONASS, Galileo, WMS, DGPS, etc. to measure the geographic position.

The turret 106 may include orthogonally mounted angular rate sensors to measure the base angular rate in 3 degrees of freedom. The turret 106 includes attitude sensors, such as tilt sensors (inclinometers) or magnetic field sensors (magnetometers) to measure the base attitude and the base attitude rate. The turret 106 may further include one or more accelerometers to measure the base velocity. The base angular rate and base attitude can be combined and filtered using a complementary filter or an extended Kalman filter to generate a six degree of freedom model of positions and/or velocities of the base to be used in ballistic compensation, stabilization and pointing.

As can be appreciated, turret sensors may vary in their design, implementation, and placement. All such devices that measure gimbal axes angles, gimbal axes angle rates, base attitude, base attitude rates, base angular rate, base velocity, and GPS may be incorporated into a turret of the present invention. As referred to herein turret data includes all information measured by a sensor included within a turret 106.

Figure 2:
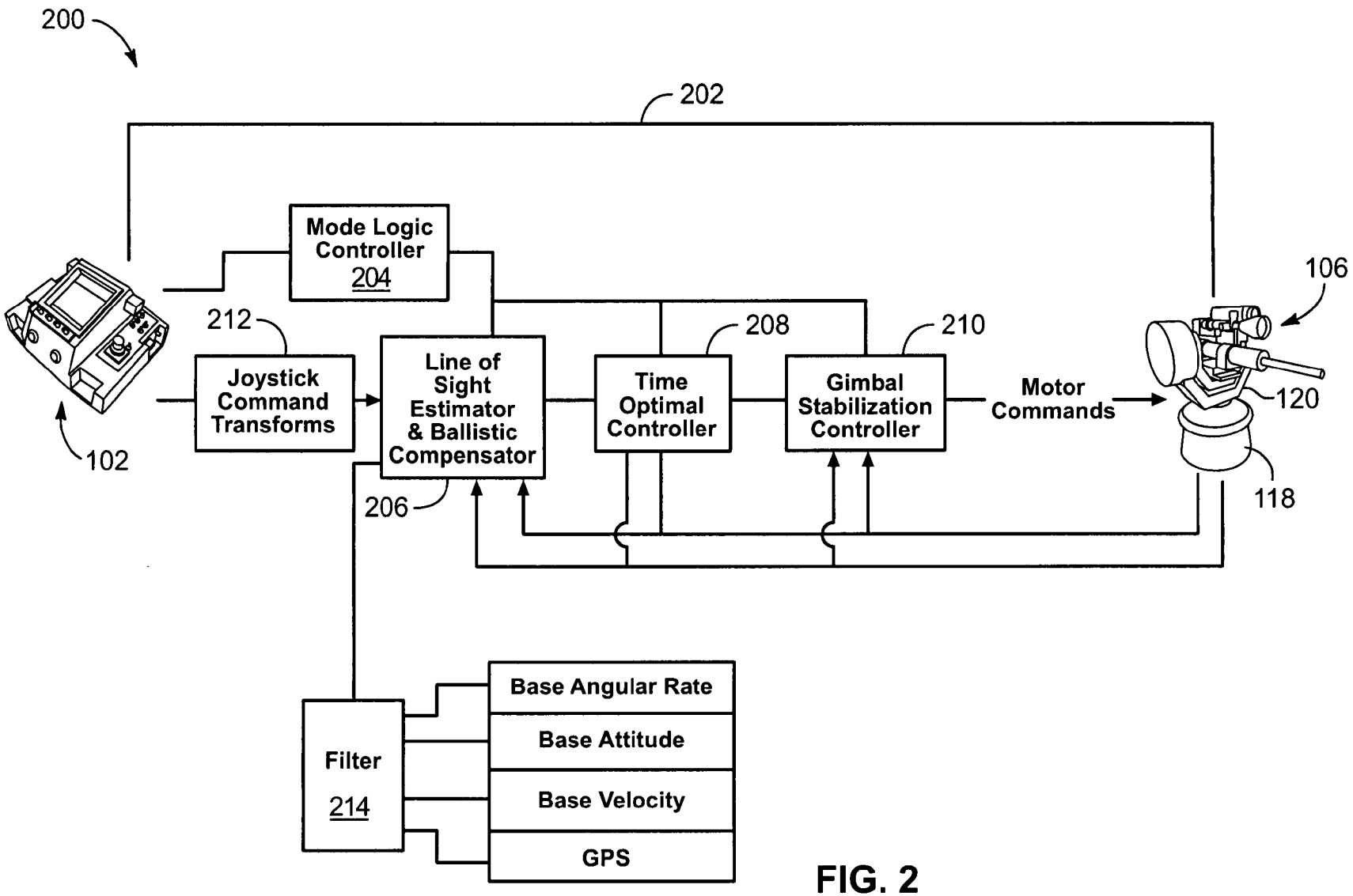
FIG. 2 is a block diagram of one embodiment of a control system for use with the weapon system of FIG. 1.

Referring to FIG. 2, a control system 200 is shown and includes modules that are used to operate the weapon system 100. The control system 200 may be implemented in software stored within the memory 116, analog hardware, or by other forms of controls such as state-space controls, or a combination thereof. The control system 200 includes a combination of cascaded control loops for gimbal stabilization, weapon pointing, and ballistics compensation. The control system 200 further provides a communication 202 between the operator console 102 and the turret 106 to transmit a trigger command to fire a weapon.

The control system 200 includes a mode logic controller 204 to configure the components of the system 200 for a selected mode. The mode logic controller 204 receives a mode command from the operator console 102 to indicate a selected mode. The modes of operation may include home, velocity, position, and tracking. The home mode moves the gimbal 120 back to a home position and retains the gimbal 120 in the home position. The velocity mode configures the system 200 to follow commanded velocity inputs. The position mode configures the system 200 to point and hold a desired position. The desired position may be determined by a certain angle or position coordinate. The tracking mode configures the system for following targets where the coordinates are predetermined either through a tracking system or target designator.

The mode logic controller 204 is in communication with a line of sight (LOS) estimator and ballistic compensator 206, a time optimal controller 208, and a gimbal stabilization controller 210 to effect their operation in accordance with a mode. In the home and velocity modes, only the gimbal stabilization controller 210 operates to direct the gimbal's rate and position. In the position and tracking modes, the LOS estimate and ballistic compensator 206, time optimal controller 208, and gimbal stabilization controller 210 all operate to stabilize and obtain position. In the tracking mode, the joystick 110 is disabled as a tracking system (not shown) replaces joystick commands. In the position mode, the joystick 110 is enabled and generates commands to obtain position.

The control system 200 includes a joystick command transform module 212 to receive joystick commands and transform the commands into the same frame of reference as the gimbal axes. The joystick command transform module 212 delivers the joystick commands to the LOS estimator and ballistics compensator 206. The turret 106 transmits sensor data indicative of gimbal axes angular rates, gimbal axes angle, base attitude rate, and base attitude.

The control system 200 further includes a filter 214 that receives sensor data from the turret 106 indicative of base angular rate, base attitude, base velocity, and GPS. The filter 214 generates a model of positions and/or velocities of the base 118. The filter 214 sends the model to the LOS estimator and ballistics compensator 206 which is used in ballistic compensation, stabilization, and pointing.

The LOS estimator and ballistics compensator 206 computes the trajectory movements needed to point at a target. The LOS estimator and ballistics compensator 206 actively computes the difference in boresight of the weapon (pitch and yaw axis) and the base's position and attitude in 3 space. The LOS estimator and ballistics compensator 206 further computes the offset due to the ballistics of a current round due to turret and mount dynamics that include linear and angular rate velocity, target range, winds, altitude and temperature.

The LOS estimator and ballistics compensator 206 computes a vector from the barrel boresight to the target. If the target coordinates are known, the LOS estimator and ballistics compensator 206 generates a vector to the target for a pointing command. To compute the LOS, the gimbal axes angles, gimbal axes angular rates, base position, base velocity, base attitude, and base angular rate are used. The LOS estimator and ballistic compensator 206 generates a vector that points from the origin of a gimbal boresight frame of reference to the origin of the target's frame of reference. The target coordinate may come from operator entered coordinates from a target recognition and tracking system.

If the target coordinates are unknown, but the target can be seen, then the distance to the target is determined. The distance to the target can be determined from a distance measuring device such as a laser rangefinder or inputted from operator estimate. The LOS is computed from the gimbal axes angles, gimbal axes angular rates, base position, base velocity, base angular rate, and base attitude. Once the LOS estimator and ballistic compensator 206 computes a vector, the distance data can be applied to determine the coordinates of the target. Once the coordinates of the target are known, standard techniques to compute the ballistic trajectory of bullet are used.

The LOS estimator and ballistic compensator 206 delivers commands to the time optimal controller 208. The time optimal controller 208 allows the LOS or position to move rapidly for large angle changes and slowly for small changes. The time optimal controller 208 may include a Luenberger compensator adapted for use with gimbals. The time optimal controller 208 can limit gimbal rates and acceleration, deal with non-linear large angle movements and linear small angle movements. The time optimal controller 208 assists with pointing by splitting movements into large angle and small angle movements. By splitting the type of movement, overshoot and pointing offset can be addressed. The time optimal controller 208 delivers commands to the gimbal stabilization controller 210 that generates motor commands to the turret 106.

Figure 3:
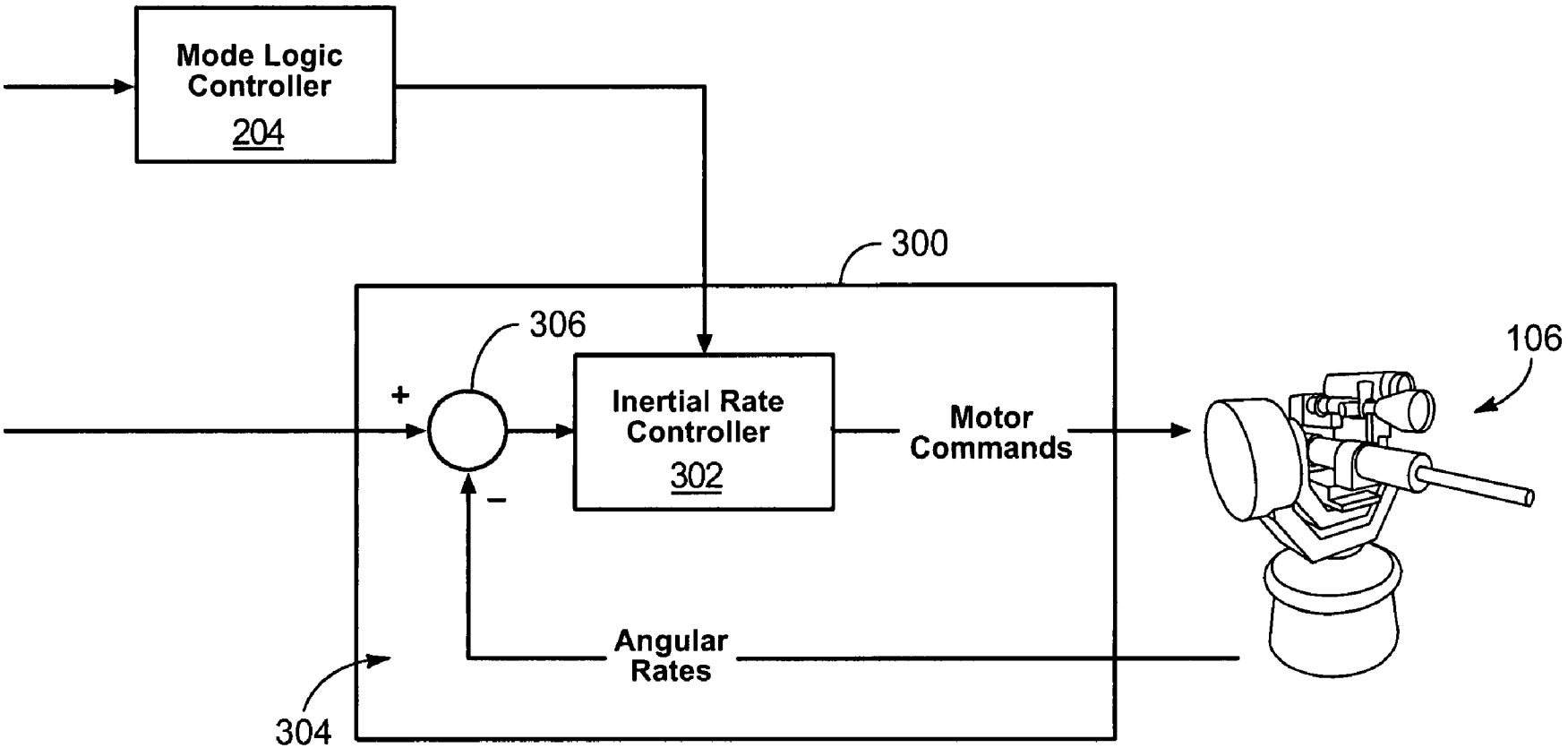
FIG. 3 is a block diagram of a gimbal stabilization controller.

Referring to FIG. 3, a gimbal stabilization controller 300 is shown. The gimbal stabilization controller 300 includes an inertial rate controller 302 that operates in conjunction with a stabilization loop 304. The intertial rate controller 302 may be implemented in various ways depending on the rate sensors used and the type of performance required by the system 200. The stabilization loop 304 provides outputs to the turret 106 and receives position feedback from the turret 106. The stabilization loop 304 and inertial rate controller 302 operate together to ensure that the gimbal 120 moves at the commanded rate and to compensate for torque disturbances due to weapon recoil, base movement, gravity, and coriolis effect.

The inertial rate controller 302 receives mode, operator commands, gimbal axes angels, gimbal axes angle rates, base attitude, and base attitude rates. The intertial rate controller 302 allows the turret 106 to move at commanded rates, but it is unable to compensate for base motion or other disturbances. The stabilization loop 304 provides a reasonable basis for most disturbance rejection such as recoil. In operation, the angular rate for each gimbal axis is received by the gimbal stabilization controller 300 and subtracted 306 from a commanded angular rate to generate an error signal. The error signal is transmitted to the inertial rate controller 302 which filters the error signal. Based on the error signal, the inertial rate controller 302 transmits torque commands to the turret 106.

Figure 4:
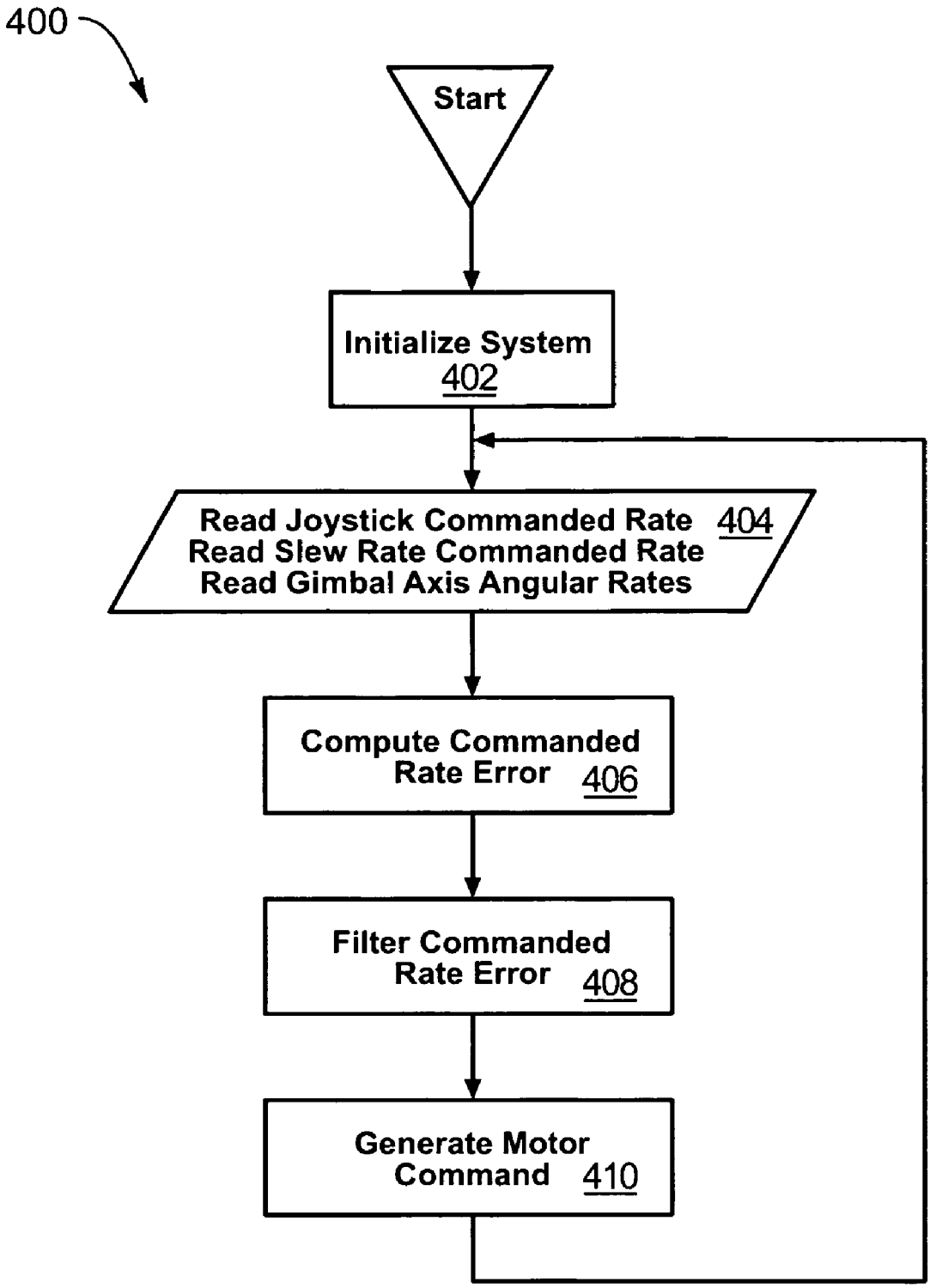
FIG. 4 is a flow diagram of a process performed in accordance with the gimbal stabilization controller of FIG. 3.

Referring to FIG. 4, a flow diagram of a method 400 performed in conjunction with the gimbal stabilization controller 300 of FIG. 3 is shown. The control system 200 commences operation by initializing 402 the system 200. The system gimbal stabilization controller 300 receives and reads 404 the joystick commanded rate, slew rate, and gimbal axes angular rates. The gimbal stabilization controller 300 computes 406 an error signal based on the difference between the measured gimbal axes angular rates and the commanded gimbal axes angular rates. The error signal is filtered 408 by the inertial rate controller 302. The inertial rate controller 302 then generates 410 motor commands to the turret 106 to control stabilization and pointing.

Figure 5:
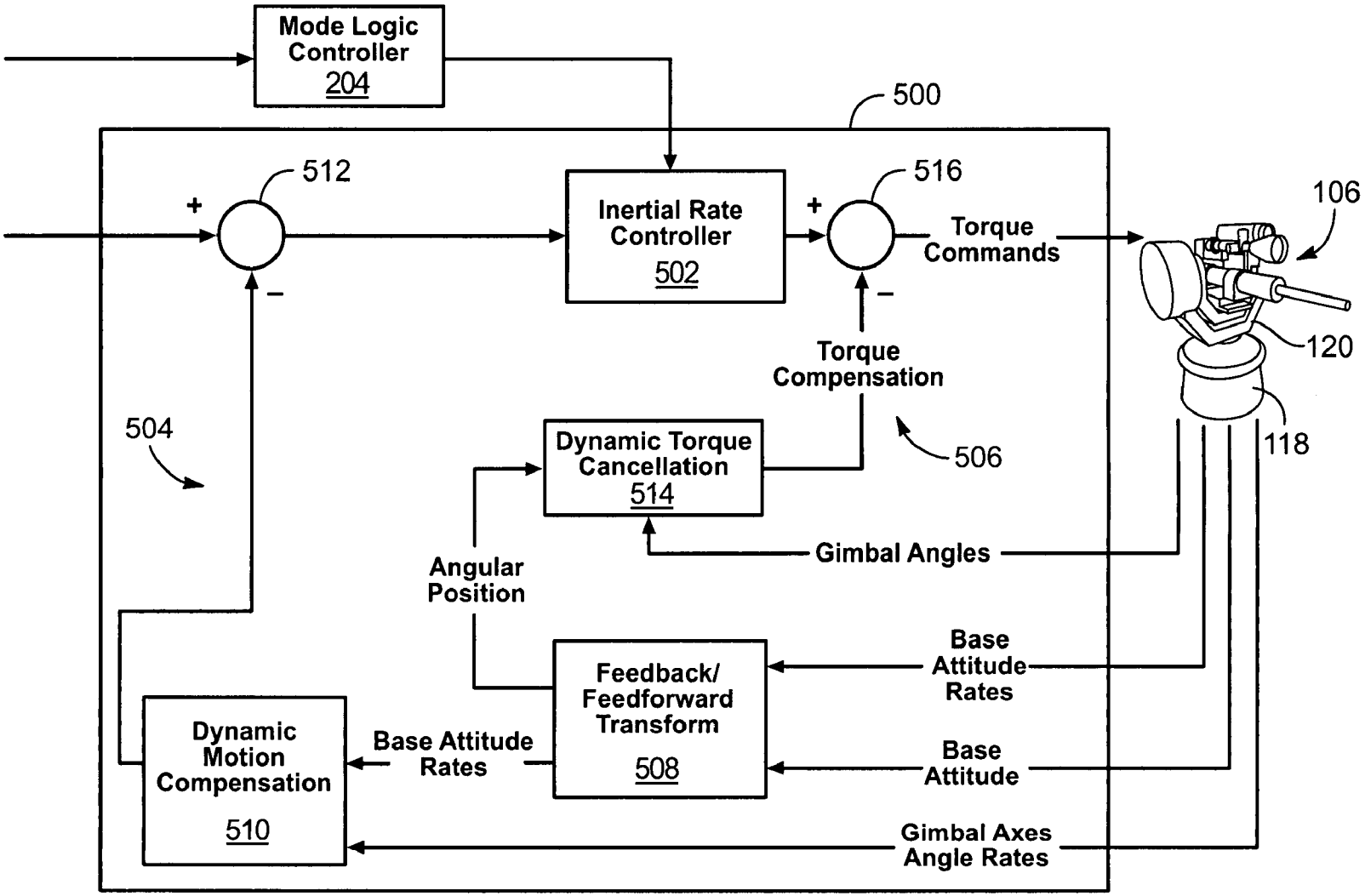
FIG. 5 is a block diagram of an embodiment of a gimbal stabilization controller in accordance with the present invention.

Referring to FIG. 5, an alternative embodiment of a gimbal stabilization controller 500 is shown. The gimbal stabilization controller 500 includes an inertial rate controller 502 that may be embodied as a second order phase lead compensator having the form of:

$$\frac{(s+z_1)(s+z_2)}{(s+p_1)(s+p_2)}.$$

The inertial rate controller 502 provides a constant output response over a broad frequency region. Depending on the desired performance, it may be required to chose $z_1$, $z_2$, $p_1$, and $p_2$ such that the response has a higher response at low frequencies and a lower response otherwise.

The gimbal stabilization controller 500 includes both feedback 504 and feedforward loops 506 for stabilization. The feedforward loop 504 addresses inadequacies of a inertial rate controller 502 which does not compensate for base angular rates, mass imbalances, or off-axis centers of gravity of the weapon system being used.

The gimbal stabilization controller 500 includes a feedback/feedforward transform module 508 that receives the base attitude and base attitude rate from the turret 106. The feedback/feedforward module 508 applies a series of spatial transformations so that the base attitude and base attitude rate are in the same frame of reference as the gimbal axes which ideally are co-planar with a weapon boresight. The frame of reference may be an earth centered inertial coordinate frame. Once all measurements are in the same frame of reference, torque and angular rate errors can be computed. Torque errors may be attributed to factors such as friction, gravity, coriolis effect, etc. The most common torque error is attributed to the center of gravity of the turret 106 not being at the intersection of the gimbal axes and weapon boresight. This misalignment generates off-axis torques that are a function of the gravity vector. The gravity vector is a function of the transformed base attitude angles and gimbal angles. Generally simple vector addition yields the gravity vector but it may not be the case for all situations, especially those where artificial gravity environments can exist due to base motion accelerations. The most desirable error is where center of gravity is located below an axis with respect to gravity. In this example, torque compensation is the common pendulum function.

The feedback/feedforward transform module 508 delivers base attitude rates to a dynamic motion compensation module 510. The dynamic motion compensation module 510 computes the gimbal angular rate by subtracting the base angular rate from the gimbal axes angular rate. This allows command rates to be achieved on a moving platform. The gimbal angular rate is then subtracted 512 from the command angular rate to generate an error signal. The inertial rate controller 502 receives the error signal, filters the error signal, and generates a proportional torque or motor command.

The feedforward loop 506 includes a dynamic torque cancellation module 514 that receives base angular position and gimbal axes angels. The dynamic torque cancellation module 514 generates torque compensation to offset effects on the base 116 such as base angular rates, mass imbalances, and off-axis centers of gravity of the weapon system being used. The generated torque compensation is summed with the proportional torque command to generate a final torque command that is transmitted to the turret 106.

Figure 6:
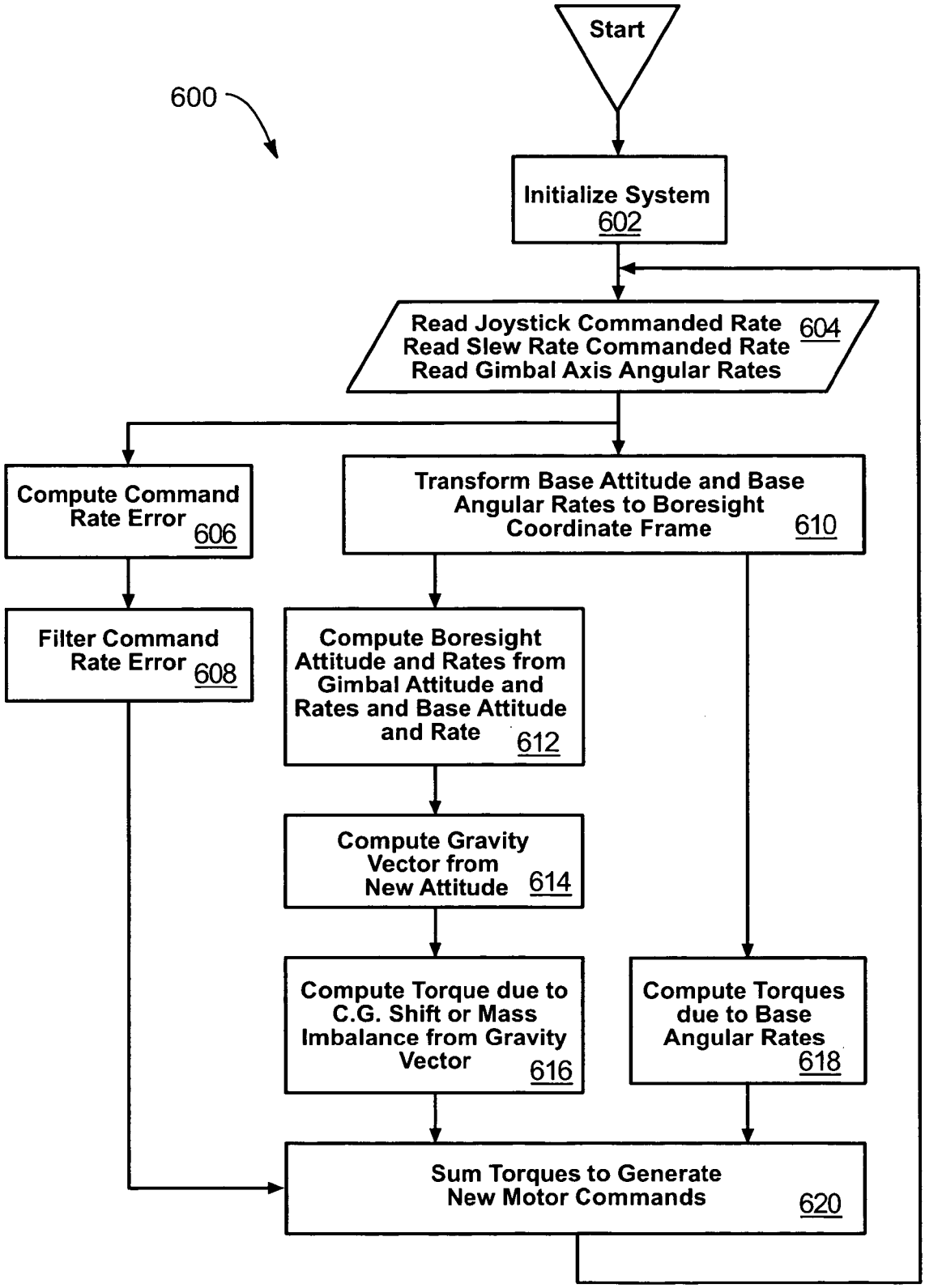
FIG. 6 is a flow diagram of a process performed in accordance with the gimbal stabilization controller of FIG. 5.

Referring to FIG. 6, a method 600 performed in accordance with a control system 200 having a gimbal stabilization controller 500 of FIG. 5 is shown. The method 600 begins by initializing 602 the control system 200. The operator commands, such as joystick commanded rate and slew rate commanded rate, as well as the gimbal axes angular rates are read 604. The gimbal stabilization controller 500 computes 606 an error signal based on the difference between the measured gimbal axes angular rates and the commanded gimbal axes angular rates. The error signal is filtered 608 by the inertial rate controller 502. The feedback/feedforward transform module transforms 610 the base attitude and base angular rates to the gimbal frame of reference, such as a boresight coordinate frame of reference.

The dynamic torque cancellation module 514 computes 612 boresight attitude and boresight rate from gimbal attitude, gimbal attitude rate, base attitude, and base attitude rate. The dynamic torque cancellation module 514 then computes 614 a gravity vector from the boresight attitude. The dynamic torque cancellation module 514 further computes 616 torque due to center of gravity shit or mass imbalance from a gravity vector. In parallel, the dynamic torque cancellation module 514 computes 618 torques due to base angular rates. The result of steps 612, 614, 616, and 618 is to generate a torque compensation which includes effects on the base 118. The torque compensation is summed 620 to modify motor or torque commands and generate new motor commands.

The control system disclosed herein improves the accuracy of point target weapons over that of the same human operated weapon, especially in high vibration environments. Furthermore, the control system may be remotely operated thus reducing the operator's exposure. The control system may be used to stabilize and point weapons up to .50 caliber in size. In order to accurately fire a point target weapon variables such as effects on the base, gravity, velocity jump, and ballistic coefficients must be known. Conventional systems do not adequately address these issues. The gimbal stabilization controller includes feedback and feedforward loops that incorporate data from sensors to allow a weapon to be precisely pointed and ballistically compensated. These sensors include measurement of gimbal axes angles, gimbal axes angular rate sensors, base position, base attitude, base attitude rates, base angular rate, and base velocity. When sensor data is processed through a filter, an accurate velocity model, both angular and linear, is generated and used for reference in LOS targeting and ballistics compensation.

It will be obvious to those having skill in the art that many changes may be made to the details of the above-described embodiments without departing from the underlying principles of the invention. The scope of the present invention should, therefore, be determined only by the following claims.

What is claimed is:

1. A computer implemented method for stabilizing a turret having a gimbal and base and pointing a weapon mounted within the turret, comprising:

receiving operator commands including a command gimbal angular rate and turret data;

generating a line of sight vector based on the turret data;

modifying the operator commands based on the line of sight vector and ballistic data;

comparing the command gimbal angular rate to a measured gimbal angular rate to generate an error signal; and generating torque commands based on the error signal to stabilize the turret and point the weapon.

2. The method of claim 1, further comprising modifying operator commands into the same frame of reference as the turret.

3. The method of claim 1, wherein the operator commands includes a selected mode and wherein modifying the operator commands, comparing the gimbal angular rate to a measured gimbal angular rate, and generating torque commands is initiated by the selected mode.

4. The method of claim 1, further comprising filtering turret data to generate a turret position model and a turret velocity model.

5. The method of claim 4, wherein the turret data includes base angular rate, base attitude, base velocity, and GPS data.

6. The method of claim 1, wherein the turret data includes gimbal axes angles, gimbal axes angular rates, base attitude, and base attitude rates.

7. The method of claim 1, further comprising:

generating a measured gimbal angular rate based on the turret data; generating torque compensation based on the turret data; and modifying the torque commands based on the torque compensation.

8. The method of claim 7, wherein the turret data includes base attitude rate and base attitude and further comprising modifying the base attitude rate and base attitude to be in the same frame of reference as the gimbal.

9. A computer implemented method for stabilizing a turret having a gimbal and base and pointing a weapon mounted within the turret, comprising:

receiving operator commands including a command gimbal angular rate and turret data;

generating a line of sight vector based on the turret data;

modifying the operator commands based on the line of sight vector and ballistic data;

comparing the command gimbal angular rate to a measured gimbal angular rate to generate an error signal;

generating torque commands based on the error signal to stabilize the turret and point the weapon;

generating a measured gimbal angular rate based on the turret data;

generating torque compensation based on the turret data; and modifying the torque commands based on the torque compensation, wherein generating torque commands based on the error signal includes application of a second order phase lead compensator having the form of:

$$\frac{(s+z_1)(s+z_2)}{(s+p_1)(s+p_2)}.$$

* * * * *